US009077127B2

(12) United States Patent
Iwano et al.

(10) Patent No.: US 9,077,127 B2
(45) Date of Patent: Jul. 7, 2015

(54) CONNECTOR ASSEMBLY

(71) Applicant: PANASONIC CORPORATION, Osaka (JP)

(72) Inventors: Hiroshi Iwano, Osaka (JP); Mitsuru Iida, Mie (JP); Daisuke Sato, Mie (JP); Hidetoshi Takeyama, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 61 days.

(21) Appl. No.: 13/935,280

(22) Filed: Jul. 3, 2013

(65) Prior Publication Data

US 2014/0017953 A1 Jan. 16, 2014

(30) Foreign Application Priority Data

Jul. 10, 2012 (JP) ..... 2012-154692

(51) Int. Cl.
*H01R 12/77* (2011.01)
*H01R 13/20* (2006.01)
*H01R 12/79* (2011.01)

(52) U.S. Cl.
CPC ..... *H01R 12/777* (2013.01); *H01R 12/79* (2013.01); *H01R 13/20* (2013.01)

(58) Field of Classification Search
CPC ..... H01R 12/777; H01R 13/20; H01R 12/79; H01R 12/52; H01R 12/55; H01R 12/62; H01R 4/58; H01R 12/7082; H05K 2201/1059; H05K 3/365
USPC ..... 439/660, 67, 77
See application file for complete search history.

(56) References Cited

U.S. PATENT DOCUMENTS

| | | | | |
|---|---|---|---|---|
| 8,267,700 | B2 * | 9/2012 | Mizoguchi | 439/67 |
| 8,708,712 | B2 * | 4/2014 | Iida | 439/67 |
| 2011/0039427 | A1 * | 2/2011 | Mizoguchi | 439/77 |
| 2011/0212631 | A1 * | 9/2011 | Iida | 439/74 |
| 2011/0269321 | A1 * | 11/2011 | Mizoguchi | 439/77 |
| 2012/0149246 | A1 * | 6/2012 | Iida et al. | 439/660 |

FOREIGN PATENT DOCUMENTS

JP 4059522 B1 3/2008

* cited by examiner

*Primary Examiner* — James Harvey
*Assistant Examiner* — Matthew T Dzierzynski
(74) *Attorney, Agent, or Firm* — McDermott Will & Emery LLP

(57) ABSTRACT

A film substrate with flexibility includes connection through holes and combining through holes into which connection posts and combining posts of the header are inserted, respectively. Each connection pad is formed around a corresponding connection through hole and adapted to be electrically connected to a corresponding connection post. Each combining pad is formed around a corresponding combining through hole and adapted to be electrically connected to a corresponding combining post. The film substrate includes slots each of which is formed to extend along a plane of the film substrate with a first end side thereof connected to a corresponding through hole. The film substrate includes pad-free parts with neither connection pad nor combining pad each of which is present at a second end side of a corresponding slot on the surface of the film substrate.

7 Claims, 7 Drawing Sheets

CONNECTOR ASSEMBLY

TECHNICAL FIELD

The invention relates to a connector assembly.

BACKGROUND OF THE INVENTION

Conventionally, there is proposed an electrical connection structure with low height, formed by fitting together a first connection member formed of a flexible print circuit (flexible printed wiring board) and a second connection member (e.g., Japanese Patent Number 4059522).

The first connection member includes a thin insulator film having flexibility as a substrate, and pads having elasticity and electrical conductivity are formed on a surface of the insulator film. The insulator film is provided with through holes which are pierced in the insulator film within the pads in a thickness direction thereof. The pads are each provided with their own pinholes communicating with the through holes.

On the other hand, the second connection member is provided with conductive protrusions, each of which is shaped like a column, at positions thereof facing the pads of the first connection member. The conductive protrusions are each adapted to be inserted into the pinholes of the pads.

When the first connection member is connected with the second connection member, the conductive protrusions are inserted into the pinholes of the pads, so that the pads are bent in an insertion direction of the conductive protrusions and are in elastic contact with the conductive protrusions by the restoring forces of the pads.

In the aforementioned electrical connection structure, the conductive protrusions are inserted into the pinholes of the pads, and thereby the pads are put into a condition of being bent in the insertion direction of the conductive protrusions into the pinholes. Here, there is a problem that excessive stress concentration occurs when the pads are connected with the conductive protrusions, because all the pads are made of electrically conducting material such as metal.

SUMMARY OF THE INVENTION

The present invention has been achieved in view of the above circumstances, and an object thereof is to provide a connector assembly capable of reducing stress occurring in spring part for electrical connection and fit holding.

In order to solve the above problem, a connector assembly (1) of the present invention comprises a female connector (10) and a male connector (20). The female connector (10) comprises a film substrate (11) and a pad (12). The film substrate (11) is made from insulating material to be shaped like a thin board with flexibility, and comprises a through hole (14) pierced in the film substrate in a thickness direction thereof. The pad (12) has electrical conductivity and is formed around the through hole (14) on a surface of the film substrate (11). The male connector (20) comprises a conductive protrusion (22) adapted to be inserted into the through hole (14) to be electrically connected to the pad (12). The film substrate (11) comprises a slot (15) that is formed to extend along a plane of the film substrate (11) with one end side thereof connected to the through hole (14). The film substrate (11) comprises part (17) without the pad (12). The part (17) is placed at least part of a region, on the surface of the film substrate (11), which is present at other end side of the slot (15) and free to be bent by the conductive protrusion (22).

In an embodiment, the conductive protrusion (22) of the male connector (20) comprises a head (24) at a tip side thereof, and the head (24) has a cross section larger than that of a base side of the conductive protrusion (22). The pad (12) is adapted to climb over the head (24) to come into contact with the base side of the conductive protrusion (22).

In an embodiment, the male connector (20) comprises a combining protrusion (22B) adapted to be inserted into a combining through hole (14B) provided in the film substrate (11) to be mechanically combined with the combining through hole (14B).

In the present invention, the part (17) without the pad (12) is placed at a region which is present at the other side of the slot (15) and free to be bent by the conductive protrusion (22). The part (17) without the pad (12) in the film substrate (11) is easy to bend in comparison with a region with the pad (12). It is therefore possible to reduce stress occurring in spring part (i.e., peripheral part of the through hole (14) in the film substrate (11)) for electrical connection and fit holding, because a stress occurring when the conductive protrusion (22) is inserted into the through hole (14) is reduced by the peripheral part of the through hole (14) being bent by the conductive protrusion (22).

BRIEF DESCRIPTION OF THE DRAWINGS

Preferred embodiments of the invention will now be described in further details. Other features and advantages of the present invention will become better understood with regard to the following detailed description and accompanying drawings where.

DETAILED DESCRIPTION OF THE INVENTION

Figure 2A:
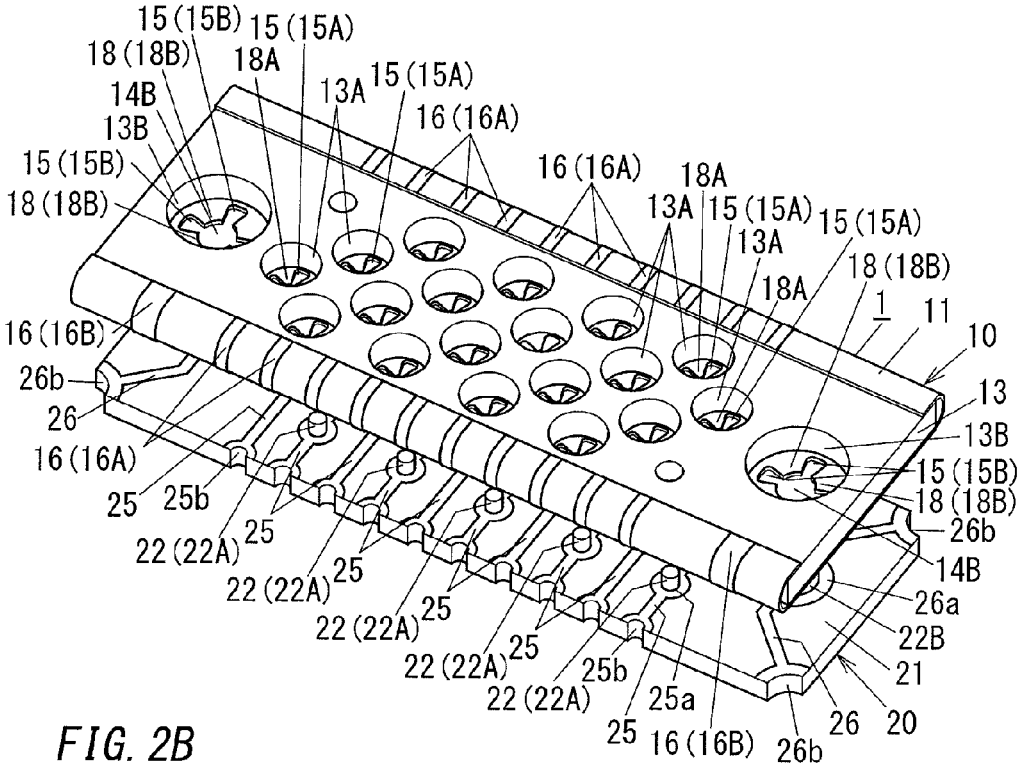
FIG. 2A is a perspective view of the connector assembly with the socket separated from a header of the connector assembly.
Figure 2B:
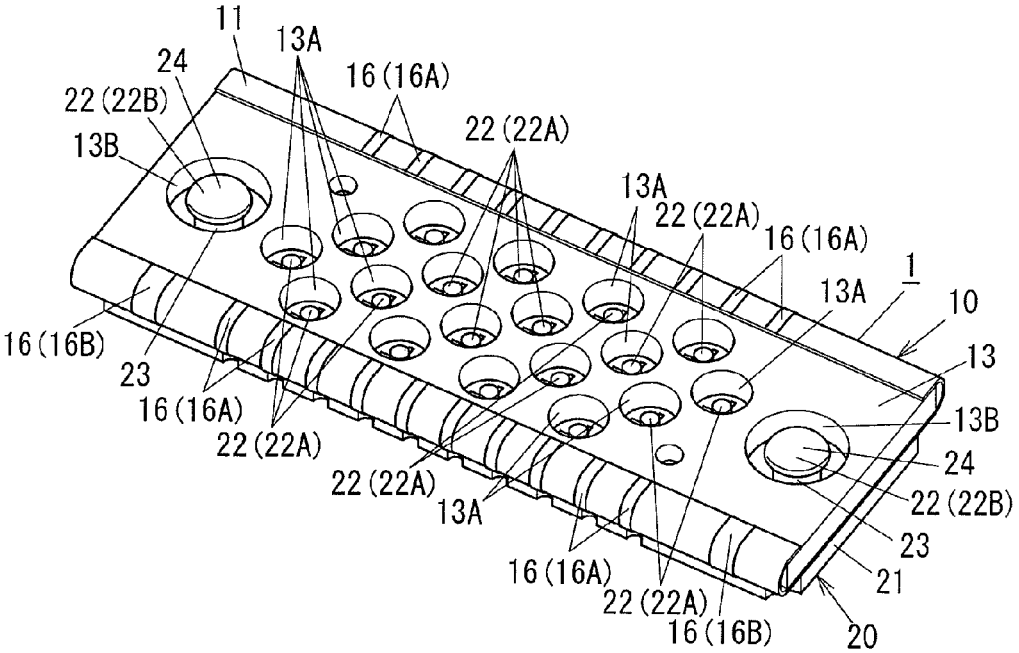
FIG. 2B is a perspective view of the connector assembly with the socket combined with the header.
Figure 3A:
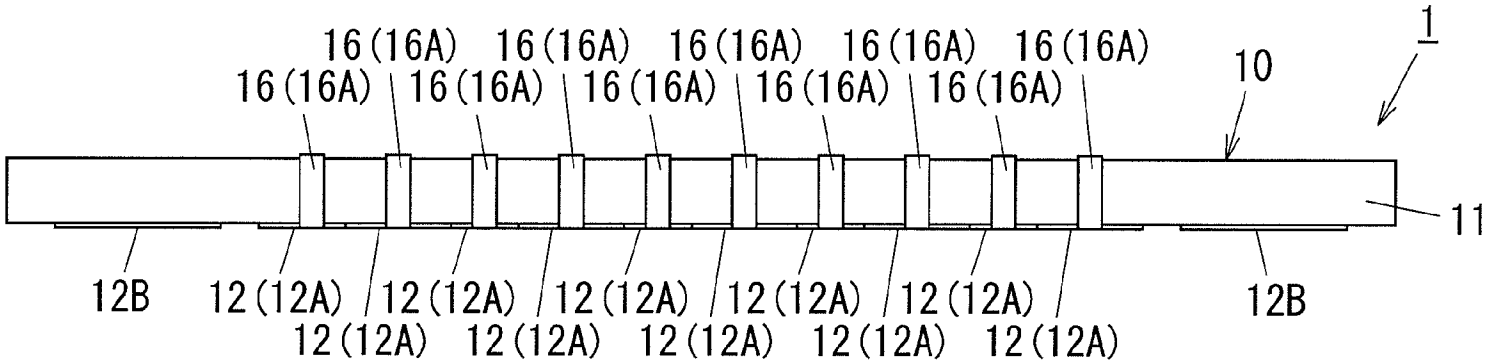
FIG. 3A is a side view of the socket.
Figure 3B:
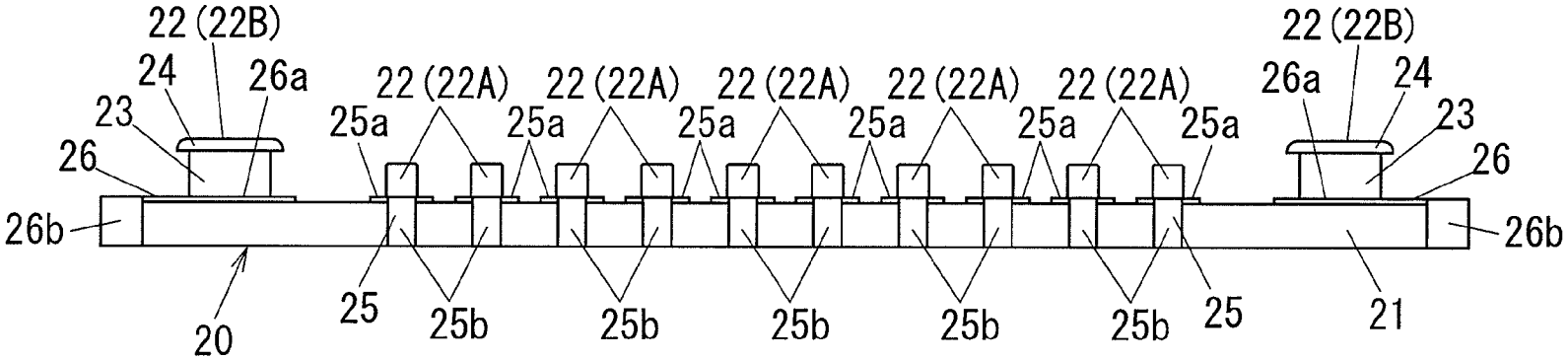
FIG. 3B is a side view of the header.

As shown in FIGS. 2 and 3, a connector assembly 1 in accordance with an embodiment of the present invention includes a socket (a female connector) 10 and a header (a male connector) 20, which are configured to be mechanically and electrically connected with each other.

In the embodiment, the socket 10 is disposed in a first side of a first direction (an upper side in an example of FIG. 2A), while the header 20 is disposed in a second side of the first direction (a lower side in the example of FIG. 2B). Therefore, in the embodiment, first and second surfaces of the socket 10 at the first and second sides of the first direction are upper and lower surfaces, respectively, and first and second surfaces of the header 20 at the first and second sides of the first direction are also upper and lower surfaces, respectively.

The socket 10 includes a film substrate 11 shaped like a rectangular board (or sheet) that is longer in a second direction perpendicular to the first direction, pads 12 made of electrically conducting material, and a reinforcing plate 13 shaped like a rectangular board that is longer in the second direction. The pads 12 include connection pads 12A and combining pads 12B.

In the embodiment, both ends of the film substrate 11 in a third direction perpendicular to the second direction are curved like a U so as to cover two longer sides of the reinforcing plate 13.

The header 20 includes a header substrate 21 shaped like a rectangular board that is longer in the second direction, and posts 22 made from electrically conducting material. The posts 22 include connection posts 22A and combining posts 22B.

The structure of the header 20 is first explained with reference to FIGS. 2-4.

The header substrate 21 is formed of a rigid substrate made from insulating material, such as an epoxy glass substrate (FR4) for example. The header substrate 21 is provided with the posts 22 protruded from a surface (an upper surface) of the header substrate 21 facing the socket 10. Each post 22 is shaped like a column. The posts 22 include connection posts 22A and combining posts 22B.

Each connection post 22A is made from electrically conducting material to be in the shape of a circular column of which cross section parallel to the upper surface of the header substrate 21 is circular in shape and substantially constant for the entire length thereof in a vertical direction (a second direction) perpendicular to the upper surface of the header substrate 21 (or the first direction). In the embodiment, the header 20 includes the connection posts 22A in sets of two or more (e.g., two), and two or more sets of (e.g., ten sets of) connection posts 22A are arranged on the upper surface of the header substrate 21 along two longer sides of the header substrate 21 five sets each so that all of the connection posts 22A are spaced at predetermined intervals in the second and third directions. Specifically, each set of connection posts 22A arranged in the second direction has two connection posts 22A arranged apart from each other in the third direction so that all of the connection posts 22A are arranged in a staggered (zigzag) array. In this arrangement, it is possible to reduce the surface area of a region where the connection posts 22A are arranged, and also to comparatively widen intervals among adjacent connection posts 22A.

The combining posts 22B are arranged on the upper surface of the header substrate 21 at both sides thereof in the second direction one each so that the ten sets of connection posts 22A intervene between the combining posts 22B. In other words, the connection posts 22A are arranged in a staggered array in a region intervening between the two combining posts 22B on the upper surface of the header substrate 21 in the second direction. Each combining post 22B is placed around the center of the upper surface of the header substrate 21 in the third direction.

Each combining post 22B includes a neck 23 that is shaped like a column and protruded from the upper surface of the header substrate 21, and a head 24 that is continuously formed on a tip of the neck 23. A size (a diameter) of the head 24 is larger than that of the neck 23. Each of the neck 23 and the head 24 is circular in cross section parallel to the upper surface of the header substrate 21, and a size (a diameter) of the cross section of the head 24 is larger than that of the neck 23. That is, the head 24 at the tip side of the combining post 22B is larger than the neck 23 at the base side thereof, and thereby the combining post 22B is shaped like somehow a mushroom. The head 24 is tapered so as to become gradually narrower from a bottom side of the head 24 to an end face side thereof.

A protrusion length of each combining post 22B from the upper surface of the header substrate 21 is set to be larger than that of each connection post 22A. Each dimension of the connection posts 22A and the combining posts 22B is set so that each height of the necks 23 except for the heads 24 is larger than each height of the connection posts 22A.

Figure 4:
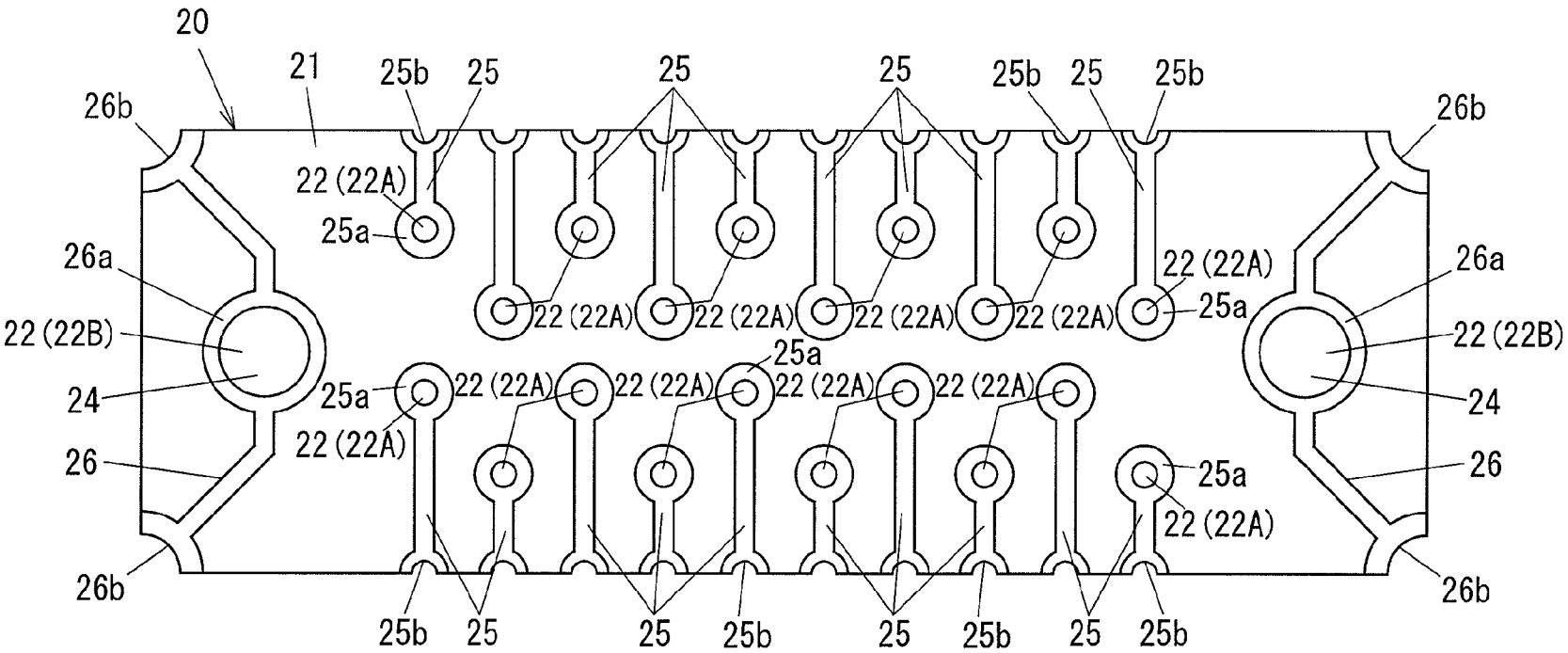
FIG. 4 is a plan view of the header.

As shown in FIG. 4, conductive patterns 25, 26 are formed on the upper surface of the header substrate 21. The conductive patterns 25 correspond to the connection posts 22A, respectively, while the conductive patterns 26 correspond to the combining posts 22B, respectively. Each connection post 22A is formed in a corresponding conductive pattern 25, and each combining post 22B is formed in a corresponding conductive pattern 26.

Figure 6:
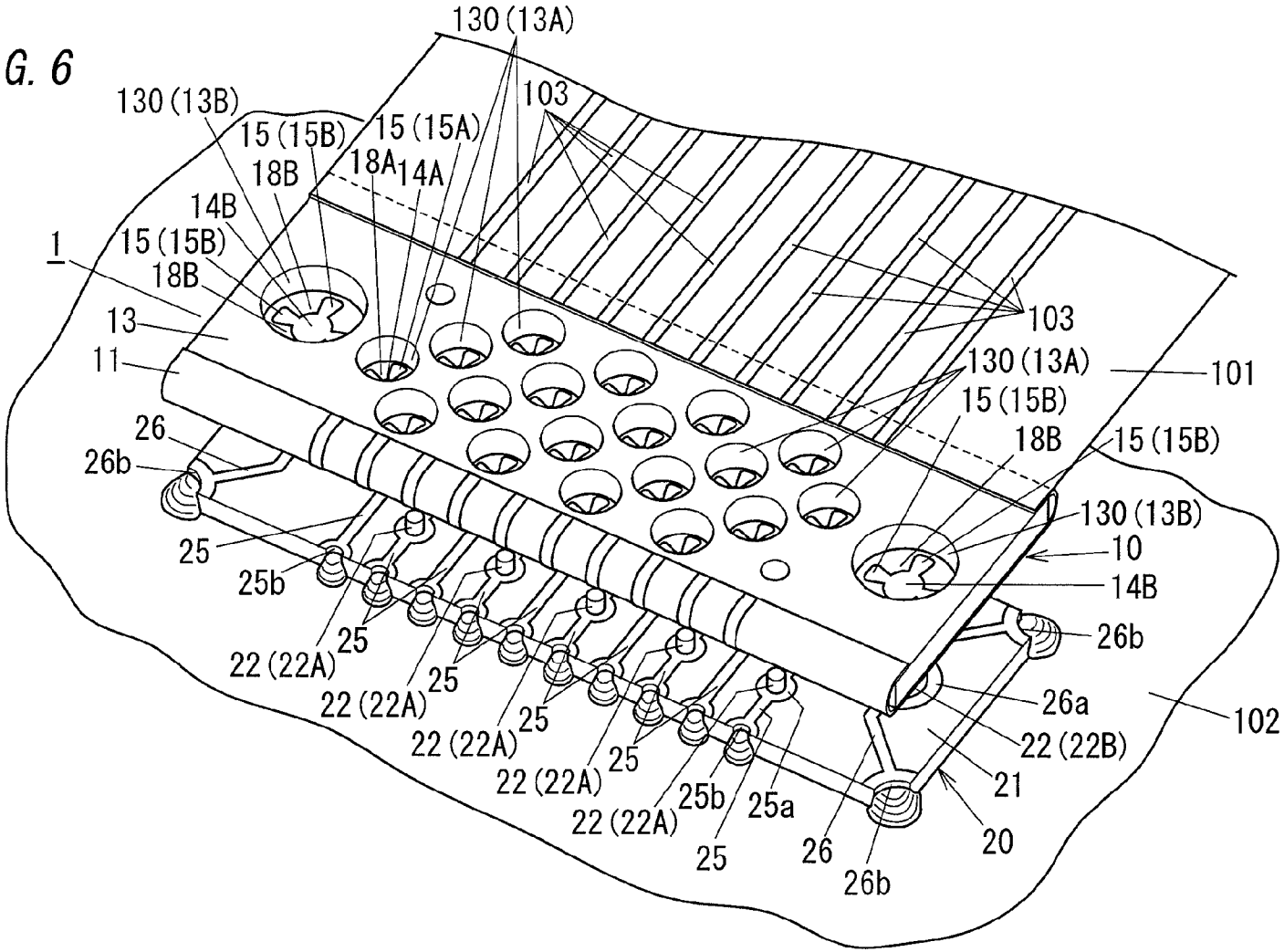
FIG. 6 is a perspective view of the connector assembly in an example of use.

Each conductive pattern 25 is formed so as to connect a land 25*a* that is shaped like a circle and placed at a position of a corresponding connection post 22A, and an edge through hole (a via recess) 25*b* that is formed at a longer side of the header substrate 21 nearer to the land 25*a*. Each conductive pattern 26 is formed so as to connect a land 26*a* that is shaped like a circle and placed at a position of a corresponding combining post 22B, and two edge through holes (via recesses) 26*b* that are formed at two corners, nearer to the land 26*a*, of four corners of the header substrate 21. The edge through holes 25*b*, 26*b* are formed by plating the sides of the header substrate 21 with electrically conducting material, and employed to mount the header substrate 21 on a circuit board 102 as shown in FIG. 6 for example.

Figure 1A:
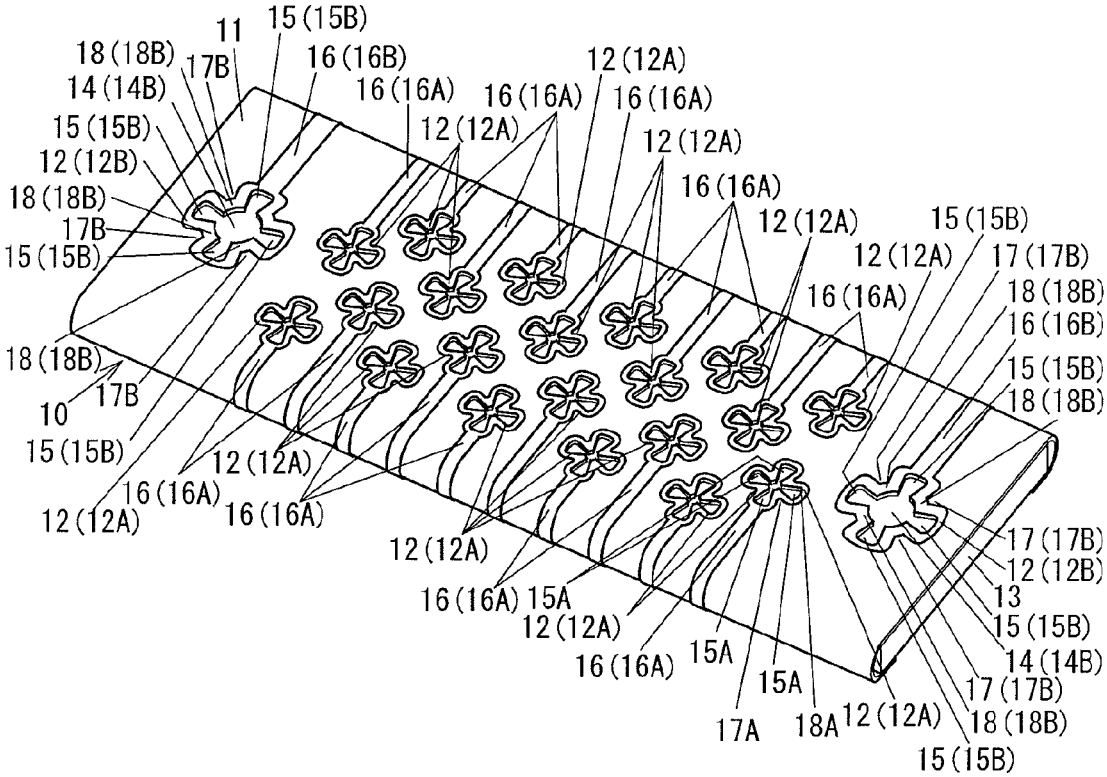
FIG. 1A is a perspective view of a socket of a connector assembly in accordance with an embodiment of the present invention.
Figure 1B:
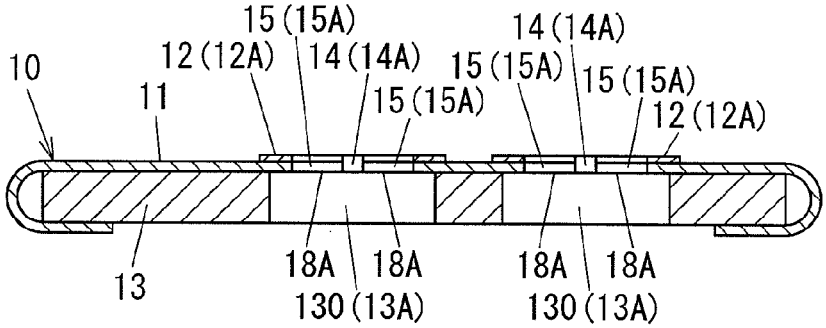
FIG. 1B is a transverse sectional view of the socket.

The structure of the socket 10 is next explained with reference to FIGS. 1-3.

The film substrate 11 is formed of a flexible substrate for assembling a flexible printed circuit (FPCB: flexible printed circuit board). The flexible substrate is made from insulating material (e.g., polyimide resin) to be shaped like a thin board (a sheet) having flexibility.

The film substrate 11 is provided with through holes 14 pierced in the film substrate 11 in the first direction (a thickness direction thereof). When the socket 10 is combined with the header 20, the posts 22 are inserted into the through holes 14, respectively. That is, the through holes 14 are placed at positions corresponding to the posts 22, respectively. The through holes 14 are separated into 2 kinds and include a connection through hole 14A placed at a position corresponding to each connection post 22A and a combining through hole 14B placed at a position corresponding to each combining post 22B. The connection through holes 14A are placed at the positions corresponding to the connection posts 22A, respectively and are accordingly arranged in a staggered array like the connection posts 22A. The combining through holes 14B are formed in the film substrate 11 at both sides thereof in the second direction one each so that the connection through holes 14A intervene between the combining through holes 14B.

Each connection through hole 14A is circular in shape and has a size (a diameter) slightly smaller than that of a corresponding connection post 22A. The film substrate 11 includes slots 15 in sets of two or more (e.g., four), corresponding to each of the through holes 14. For example, the slots 15 in the film substrate 11 are separated into 2 kinds and include a slot 15A as an element of a set corresponding to each connection through hole 14A and a slot 15B as an element of a set corresponding to each combining through hole 14B. Four slots 15A corresponding to each connection through hole 14A are pierced in the film substrate 11 in the first direction (the thickness direction thereof) and extend in the second and third directions from a corresponding connection through hole 14A. Each slot 15A, of which first end is connected to a corresponding connection through hole 14A, becomes gradually wider in width from the first end to a second end thereof. That is, a connection through hole 14A and four slots 15A corresponding to each connection post 22A constitute an opening shaped like a clover, of which sizes in the second and third directions are set to be larger than a size (a diameter) of a corresponding connection post 22A.

Each combining through hole 14B is circular in shape and has a size (a diameter) slightly smaller than that of the neck 23 of a corresponding combining post 22B. Four slots 15B corresponding to each combining through hole 14B are pierced in the film substrate 11 in the first direction (the thickness direction thereof) and extend in the second and third directions from a corresponding combining through hole 14B. Each slot 15B, of which first end is connected to a corresponding combining through hole 14B, becomes gradually wider in width from the first end to a second end thereof. That is, a combining through hole 14B and four slots 15B corresponding to each combining post 22B constitute an opening shaped like a clover, of which sizes in the second and third directions are set to be larger than each size (diameter) of the neck 23 and the head 24 of a corresponding combining post 22B.

The film substrate 11 further includes pads 12, conductive patterns 16, and pad-free parts 17 corresponding to the through holes 14, respectively. For example, the pads 12 in the film substrate 11 are separated into 2 kinds and include a connection pad 12A corresponding to each of the connection through holes 14A (or the connection posts 22A) and a combining pad 12B corresponding to each of the combining through holes 14B (or the combining posts 22B). The conductive patterns 16 in the film substrate 11 are separated into 2 kinds and include a conductive pattern 16A corresponding to each of the connection pads 12A (or the connection through holes 14A) and a conductive pattern 16B corresponding to each of the combining pads 12B (or the combining through holes 14B). The pad-free parts 17 in the film substrate 11 are separated into 2 kinds and include a pad-free part 17A corresponding to each of the connection pads 12A (or the connection through holes 14A) and a pad-free part 17B corresponding to each of the combining pads 12B (or the combining through holes 14B). Each pad 12A is formed by copper plating around a corresponding connection through hole 14A on a surface (a second surface) of the film substrate 11 (a surface facing the header 20), and adapted to be electrically connected to a corresponding connection post 22A. Each pad 12A is placed on the whole of the periphery of the opening formed of corresponding connection through hole 14A and slots 15A, and is electrically connected to a corresponding conductive pattern 16A on the second surface of the film substrate 11. Each pad-free part 17A is placed at least part of a region, on the second surface of the film substrate 11, which is present at the second end side of a corresponding slot 15A and free to be bent by a corresponding connection post 22A. Specifically, two or more pad-free parts 17A are placed at two or more locations of a region, on the second surface of the film substrate 11, which are present at the second end sides of two or more slots 15A connected to a corresponding connection through hole 14A and free to be bent by a corresponding connection post 22A. In the embodiment, four pad-free parts 17A are placed at four locations of a region, on the second surface of the film substrate 11, which are present at the second end sides of four slots 15A connected to a corresponding connection through hole 14A and free to be bent by a corresponding connection post 22A. Each pad-free part 17A exposes part of the second surface of the film substrate 11.

Similarly, each pad 12B is formed by copper plating around a corresponding combining through hole 14B on the second surface of the film substrate 11, and adapted to be electrically connected to a corresponding combining post 22B. Each pad 12B is placed on the whole of the periphery of the opening formed of corresponding combining through hole 14B and slots 15B, and is electrically connected to a corresponding conductive pattern 16B. Each pad-free part 17B is placed at least part of a region, on the second surface of the film substrate 11, which is present at the second end side of a corresponding slot 15B and free to be bent by a corresponding combining post 22B. Specifically, two or more pad-free parts 17B are placed at two or more locations of a region, on the second surface of the film substrate 11, which are present at the second end sides of two or more slots 15B connected to a corresponding combining through hole 14B and free to be bent by a corresponding combining post 22B. In the embodiment, four pad-free parts 17B are placed at four locations of a region, on the second surface of the film substrate 11, which are present at the second end sides of four slots 15B connected to a corresponding combining through hole 14B and free to be bent by a corresponding combining post 22B. Each pad-free part 17B exposes part of the second surface of the film substrate 11. Note that if the combining posts 22B are not used for electrical connection, the pads 12B and the conductive patterns 16B are unnecessary.

The pads 12A, 12B are made: of material having electrical conductivity and elasticity; and by forming copper patterns, having 9 μm in thickness, on the second surface of the film substrate 11 having electric non-conductance for example. Also, nickel or nickel alloy may be plated on surfaces of the copper patterns of the pads 12A, 12B.

The reinforcing plate 13 is, for example, made of nickel silver to be shaped like a rectangular board which has a length similar to that of the header substrate 21 in the second direction, and a width rather larger than that of the header substrate 21 in the third direction. The reinforcing plate 13 is pasted on a back of the surface of the film substrate 11 facing the header 20. The reinforcing plate 13 has a length similar to that of the film substrate 11 in the second direction, and a width shorter than that of the film substrate 11 in the third direction. Accordingly, the film substrate 11 is pasted on the surface (second surface) of the reinforcing plate 13, and remaining ends thereof (11) in the third direction are wrapped round the reinforcing plate 13 with the remaining ends turned around a back of the reinforcing plate 13. Tip ends of the conductive patterns 16A, 16B are also turned around the back of the reinforcing plate 13 along with the remaining ends of the film substrate 11.

The reinforcing plate 13 includes holes 130. For example, the holes 130 are separated into 2 kinds and include a hole 13A corresponding to each of the connection through holes 14A and a hole 13B corresponding to each of the combining through holes 14B. Each hole 13A has the same center as a corresponding connection through hole 14A, and an inside dimension (an internal diameter) larger than that of the hole 14A and an external dimension (an outer diameter) of a corresponding connection post 22A so that the corresponding connection through hole 14A is formed therein (13A). Therefore, a connection pad 12A placed on each periphery of the connection through holes 14A is extended inward from the inner circumferential surface of a corresponding hole 13A.

Each hole 13B has the same center as a corresponding combining through hole 14B, and an inside dimension (an internal diameter) larger than that of the hole 14B and an external dimension (an outer diameter) of a corresponding combining post 22B (head 24) so that the corresponding combining through hole 14B is formed therein (13B). Therefore, a combining pad 12B placed on each periphery of the combining through holes 14B is extended inward from the inner circumferential surface of a corresponding hole 13B.

Figure 5:
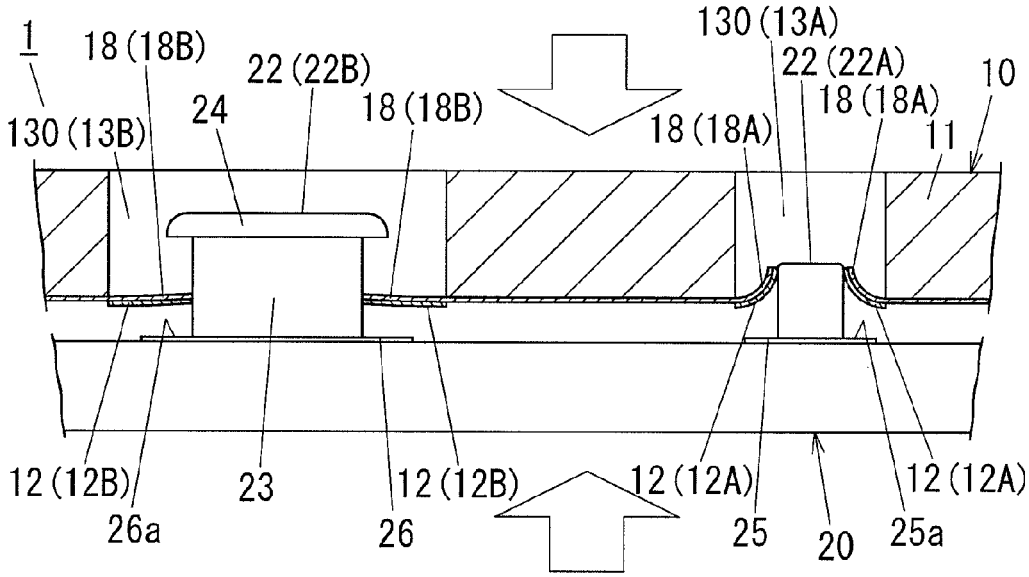
FIG. 5 illustrates main parts of the connector assembly and shows a combination state of the connector assembly.

Accordingly, when the socket 10 is connected with the header 20, the connection posts 22A are inserted into the respective holes 13A through the respective connection through holes 14A, and the connection pads 12A come into contact with respective peripheral surfaces of the posts 22A, while the combining posts 22B are inserted into the respective holes 13B through the respective combining through holes 14B, and the combining pads 12B come into contact with respective peripheral surfaces of the necks 23 of the combining posts 22B (see FIG. 5).

Each pad 12 is formed based on material and thickness dimension which are chosen and decided so as to have not only electrical conductivity but also elasticity (shape restoring force). Accordingly, elasticity is given to each of parts in which at least the pads 12 in the film substrate 11 are formed. That is, the film substrate 11 includes spring pieces 18 each of which is formed of part thereof (11) extended inward from the inner circumferential surface of a corresponding hole 130. The spring pieces 18 are separated into 2 kinds and include a spring piece 18A as an element of a set corresponding to each of the holes 13A and a spring piece 18B as an element of a set corresponding to each of the holes 13B. Each pad 12A is formed around tip ends of a corresponding set of (four) spring pieces 18A, while each pad 12B is formed around tip ends of a corresponding set of (four) spring pieces 18B. The film substrate 11 includes at least part (17) without the pad 12 on the surface (the second surface) of the film substrate 11. The part (17) without pad 12 is placed at least part of a region, on the surface of the film substrate 11, which is present at other end side of the slot 15 (the other side thereof from the side connected to the through hole 14) and free to be bent by the post 22. In the embodiment, each pad-free part 17A corresponding to one connection through hole 14A is present at the second end sides of two adjacent slots 15A (or between them) and free to be bent by a corresponding connection post 22A. Each pad-free part 17B corresponding to one combining through hole 14B is present at the second end sides of two adjacent slots 15B (or between them) and free to be bent by a corresponding combining post 22B. That is, each of the spring pieces 18A is provided with a pad-free part 17A with neither pad 12A nor pad 12B, and each of the spring pieces 18B is provided with a pad-free part 17B with neither pad 12A nor pad 12B. It is accordingly possible to improve each elasticity of the spring pieces 18A, 18B in comparison with the case where each pad 12A is formed on the whole of a corresponding spring piece 18A and each pad 12B is formed on the whole of a corresponding spring piece 18B.

Figure 7A:
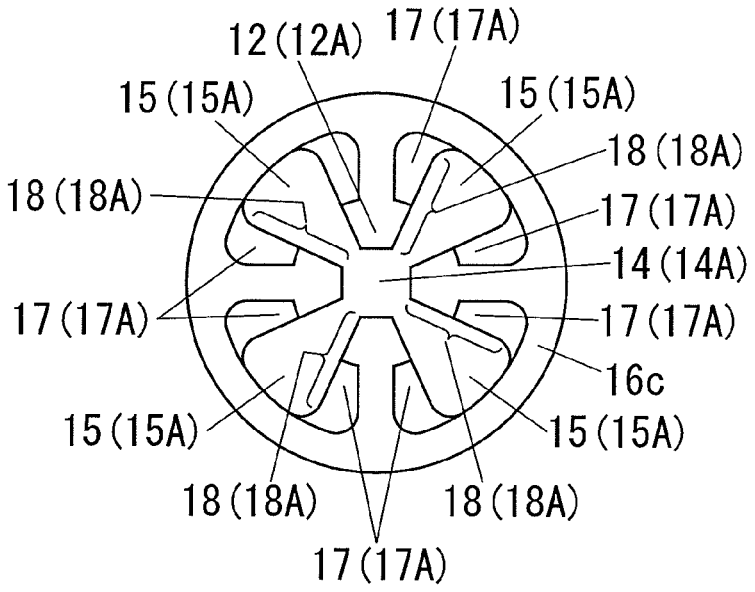
FIG. 7A is a plan view of a connection pad of the socket.
Figure 7B:
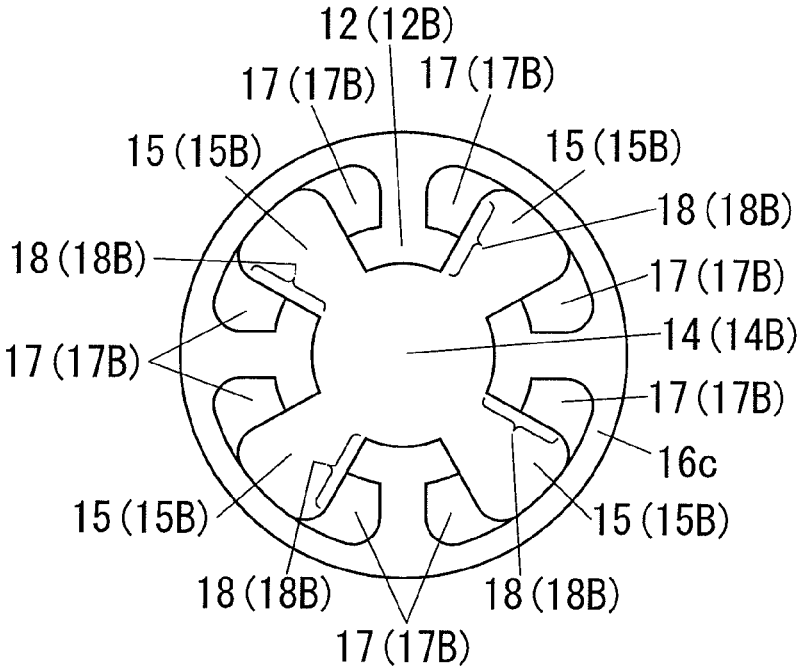
FIG. 7B is a plan view of a combining pad of the socket.

Numerous modifications can be applied to each shape of the pad-free parts 17A, 17B of the spring pieces 18A, 18B with neither pad 12A nor pad 12B, and the shapes are not limited to the illustrated shapes. In the example of FIG. 1, a pad-free part 17A is placed around the center of a corresponding spring piece 18A in a width direction thereof, and a connection pad 12A is placed at each end of the spring piece 18A in the width direction, but may be placed at other part of the spring piece 18A. Similarly, a pad-free part 17B is placed around the center of a corresponding spring piece 18B in a width direction thereof, and a combining pad 12B is placed at each end of the spring piece 18B in the width direction, but may be placed at other part of the spring piece 18B. For example, as shown in FIG. 7A, a pad-free part 17A may be placed at each end of a corresponding spring piece 18A in a width direction thereof. Similarly, as shown in FIG. 7B, a pad-free part 17B may be placed at each end of a corresponding spring piece 18B in a width direction thereof. It is also possible to improve each elasticity of the spring pieces 18A, 18B to prevent excessive stress concentration from occurring, as above. A connection pad 12A placed at a tip of each spring piece 18A is electrically connected with a ring shaped electric conductor 16C placed in the outer circumference of corresponding slots 15A through a conductive pattern formed on the center of the spring piece 18A in a width direction thereof. Similarly, a connection pad 12B placed at a tip of each spring piece 18B is electrically connected with a ring shaped electric conductor 16C placed in the outer circumference of corresponding slots 15B through a conductive pattern formed on the center of the spring piece 18B in a width direction thereof. Each conductor 16C is electrically connected with a corresponding conductive pattern (16A or 16B).

As shown in FIG. 5, when the socket 10 is electrically connected with the header 20, each connection post 22A comes into contact with the spring pieces 18A around a corresponding connection through hole 14A and is then inserted into the connection through hole 14A while elastic deforming the spring pieces 18A to widen the connection through hole 14A. Spring pieces 18A around each connection through hole 14A press, by their elastic forces, a corresponding connection pad 12A against the peripheral surface of a corresponding connection post 22A. As a result, each connection post 22A is electrically connected with a corresponding connection pad 12A. Similarly, each combining post 22B comes into contact with the spring pieces 18B around a corresponding combining through hole 14B and is then inserted into the combining through hole 14B while elastic deforming the spring pieces 18B to widen the combining through hole 14B. Spring pieces 18B around each combining through hole 14B press, by their elastic forces, a corresponding combining pad 12B against the peripheral surface of the neck 23 of a corresponding combining post 22B. As a result, each combining post 22B is electrically connected with a corresponding combining pad 12B.

Each connection post 22A is substantially constant in outer diameter for the entire length thereof in the first direction (the vertical direction), and has no protrusion like each combining post 22B. Therefore, each connection post 22A has no part hooked to a corresponding connection pad 12A when being inserted into a corresponding connection through hole 14A, and accordingly hardly contributes to mechanical connection between the socket 10 and the header 20. On the other hand, each combining post 22B is shaped like a mushroom so that the head 24 at a tip side thereof is larger than the neck 23 at a base side thereof. Accordingly, when the socket 10 is connected to the header 20, spring pieces 18B corresponding to each combining through hole 14B climb over the head 24 of a corresponding combining post 22B to come into contact with the neck 23 of the combining post 22B. Therefore, the tips of spring pieces 18B around each combining through hole 14B are hooked to the head 24 of a corresponding combining post 22B, thereby providing retainer of the above combining post 22B along with the head 24 to mechanically connect the socket 10 and the header 20. As an example, each connection post 22A may be shaped like a mushroom in the same way as each combining post 22B. In this case, it is possible to connect the socket 10 and the header 20 through the connection posts 22A.

When the socket 10 is withdrawn from the header 20, each combining post 22B is withdrawn from a corresponding combining through hole 14B while elastic deforming spring pieces 18B around the hole 14B to widen the hole 14B. At this time, the tips of spring pieces 18B around each combining through hole 14B hooks to a head 24 of a corresponding combining post 22B, but if the strength for withdrawing the socket 10 from the header 20 is relatively large, the above spring pieces 18B elastic deform and then the tips thereof climb over the above head 24. As a result, each combining post 22B is withdrawn from a corresponding combining through hole 14B. On the other hand, each connection post 22A is shaped like a column that is substantially constant in outer diameter for the entire length thereof in the vertical direction (the second direction). Therefore, when the socket 10 is withdrawn from the header 20, spring pieces 18A around each connection through hole 14A do not hook to a corresponding connection post 22A. As a result, the above spring pieces 18A can be easily withdrawn from a corresponding connection through hole 14A.

That is, when combining the socket 10 with the header 20, a user has only to align each through hole 14 with a corresponding post 22 and then press the film substrate 11 against the header substrate 21 from above (from the upper side as shown in FIG. 5). As a result, each connection post 22A is inserted into a corresponding connection through hole 14A to be electrically connected to a corresponding connection pad 12A. In addition, each combining post 22B is inserted into a corresponding combining through hole 14B to be electrically connected to a corresponding combining pad 12B, thereby electrically connecting the socket 10 and the header 20. The tips of spring pieces 18B around each combining through hole 14B are hooked to the head 24 of a corresponding combining post 22B, thereby providing retainer of the above combining post 22B along with the head 24 to mechanically connect the socket 10 and the header 20.

When withdrawing the socket 10 from the header 20, a user has only to move the film substrate 11 upward from the header substrate 21. As a result, each combining post 22B is withdrawn from a corresponding connection through hole 14B and then the socket 10 is mechanically disconnected from the header 20. In addition, each connection post 22A is withdrawn from a corresponding connection through hole 14A, while each combining post 22B is withdrawn from a corresponding combining through hole 14B, and thereby each pad 12 (12A, 12B) is separated from a corresponding post 22 (22A, 22B). Therefore, the socket 10 is electrically disconnected from the header 20.

As shown in FIG. 6, the connector assembly 1 in the embodiment is used to mechanically and electrically connect two circuit boards. In the example of FIG. 6, the socket 10 is mounted on a circuit board 101 formed of a flexible print circuit (a flexible printed wiring board), while the header 20 is mounted on a circuit board 101 formed of a rigid substrate. Therefore, if the socket 10 is combined with the header 20, the two circuit boards 101, 102 are electrically and mechanically connected with each other. The conductive patterns 16A, 16B of the socket 10 are joined to conductive patterns 103 of the circuit board 101 with solder, and thereby the socket 10 is mounted on the circuit board 101. The edge through holes 25*b*, 26*b* of the header 20 are joined to conductive patterns (not shown) on a surface of the circuit board 102 with solder, and thereby the header 20 is mounted on the surface of the circuit board 102.

The socket 10 and the header 20 constituting the connector assembly 1 can be produced by the manufacturing method disclosed in Japanese Patent Application Publication No. 2012-059420, and accordingly the method for the connector assembly 1 is not described in detail herein.

In the embodiment, the connector assembly 1 includes the socket 10 (female connector) and the header 20 (male connector). The socket 10 includes the film substrate 11 and the pads 12 (12A, 12B). The film substrate 11 is made from insulating material to be shaped like a thin board with flexibility, and includes through holes 14 (the connection through holes 14A and the combining through holes 14B) pierced in the film substrate 11 in the thickness direction (the first direction). Each pad 12 is formed around a corresponding through hole 14 on a surface (the second surface) of the film substrate 11. The header 20 includes conductive protrusions (the posts 22 formed of the connection posts 22A and the combining posts 22B) each of which is adapted to be inserted into a corresponding through hole 14 to be electrically connected to the pad 12 around the hole 14. The film substrate 11 includes the slots 15 (15A, 15B) each of which is formed to extend along a plane of the film substrate 11 with one end side (a first end side) thereof (15) connected to a corresponding through hole 14. The part 17 (pad-free part 17A, 17B) is placed at least part of a region, on the surface of the film substrate 11, which is present at other end side of the slot 15 and free to be bent by the post 22.

Thus, each part 17 without pad 12 is placed at a region which is present at the second end sides of a corresponding slots 15 and free to be bent by a corresponding post 22 (i.e., spring piece 18A, 18B). A part 17 without pad 12 in each spring piece 18A, 18B consists of only the film substrate 11 and is easy to bend in comparison with part with pad 12 therein. It is therefore possible to reduce stress occurring in each spring part (i.e., spring piece 18A, 18B) for electrical connection and fit holding, because a stress occurring when each post 22 is inserted into a corresponding through hole 14 is reduced by the peripheral part of the through hole 14 being bent by the post 22.

Each post 22 of the header 20 includes a head 24 at a tip side thereof, and the head 24 has a cross section larger than that of a base side of the post 22. Each pad 12 is adapted to climb over the head 24 of a corresponding combining post 22 to come into contact with the base side (the neck 23) of the post 22.

Thus, each pad 12 is in contact with the base side (the neck 23) of a corresponding combining post 22, and accordingly each pad 12 hooks to the head 24 of the post 22, thereby preventing the post 22 from coming out of a corresponding through hole 14. In the embodiment, only each combining post 22B is shaped like a mushroom, but each connection post 22A may be shaped like a mushroom in the same way as each combining post 22B.

The header 20 includes the combining posts (combining protrusion) 22B each of which is adapted to be inserted into a corresponding combining through hole 14B provided in the film substrate 11 to be mechanically combined with the combining through hole 14B.

Thus, each combining post (combining protrusion) 22B is combined with a corresponding combining through hole 14B, thereby preventing the socket 10 from coming out of the header 20 to mechanically and rigidly combine the socket 10 with the header 20.

Although the present invention has been described with reference to certain preferred embodiments, numerous modifications and variations can be made by those skilled in the art without departing from the true spirit and scope of this invention, namely claims.

What is claimed is:

1. A connector assembly, comprising:

a female connector comprising: a film substrate which is made from insulating material shaped in a thin board shape with flexibility; and a through hole pierced in the film substrate in a thickness direction thereof; and a pad which has electrical conductivity and is formed on a surface of the film substrate around the through hole; and a male connector comprising a conductive protrusion adapted to be inserted into the through hole to be electrically connected to the pad, wherein:

the film substrate comprises a slot that is formed to extend along a plane of the film substrate and one end side of the slot is connected to the through hole, and the film substrate comprises non-pad part without the pad, the non-pad part being placed at least part of a region, on the surface of the film substrate, which is present at another end side of the slot and free to be bent by the conductive protrusion, the non-pad part adjoining the slot with no pad intervening between the slot and the non-pad part.

2. The connector assembly of claim 1, wherein:

the conductive protrusion of the male connector comprises a head at a tip side thereof, the head having a cross section larger than a cross section of a base side of the conductive protrusion, and the pad is adapted to pass through the head to come into contact with the base side of the conductive protrusion.

3. The connector assembly of claim 1, wherein the male connector comprises a combining protrusion adapted to be inserted into a combining through hole provided in the film substrate to be mechanically combined with the combining through hole.

4. The connector assembly of claim 2, wherein the male connector comprises a combining protrusion adapted to be inserted into a combining through hole provided in the film substrate to be mechanically combined with the combining through hole.

5. The connector assembly of claim 1, wherein:

the female connector comprises a reinforcing plate that comprises a hole corresponding to the through hole, the film substrate comprises a spring piece that is formed of part of the film substrate extended inward from an inner circumferential surface of the hole of the reinforcing plate, and the non-pad part is placed at each end of the spring piece in a width direction of the spring piece.

6. The connector assembly of claim 5, wherein:

the female connector comprises a ring shaped electric conductor placed in an outer circumference of the slot, the pad is placed at a tip of the spring piece, and the pad is electrically connected with the ring shaped electric conductor through a conductive pattern formed on a center of the spring piece in a width direction of the spring piece.

7. The connector assembly of claim 6, wherein the non-pad part is disposed between the slot and the conductive pattern.

* * * * *